US007361074B1

(12) United States Patent
Periman et al.

(10) Patent No.: US 7,361,074 B1
(45) Date of Patent: Apr. 22, 2008

(54) ROTATING LIGHT TOY

(75) Inventors: Douglas M. Periman, Paradise, CA (US); Ronald A. Angstead, Longmont, CO (US); Patrick Bertsch, Thornton, CO (US); Brent W. Murray, Longmont, CO (US); Armand J. Ferraro, Jr., Longmont, CO (US); Ralph M. Martin, Longmont, CO (US)

(73) Assignee: Rapid Pro Manufacturing, Martin and Periman Partnership, Longmont, CO (US)

( * ) Notice: Subject to any disclaimer, the term of this patent is extended or adjusted under 35 U.S.C. 154(b) by 0 days.

(21) Appl. No.: 11/061,206

(22) Filed: Feb. 18, 2005

(51) Int. Cl.

| | |
|---|---|
| ***A63H 1/24*** | (2006.01) |
| ***A63H 1/28*** | (2006.01) |
| ***F21L 4/04*** | (2006.01) |
| ***F21L 13/00*** | (2006.01) |

(52) U.S. Cl. ..... 446/242; 446/265; 446/266; 362/192; 362/199

(58) Field of Classification Search ..... 446/236, 446/242, 266, 239, 240, 265, 397, 484, 285; 362/35, 159, 199, 192, 193, 399, 446; 340/471; 322/1

See application file for complete search history.

(56) References Cited

U.S. PATENT DOCUMENTS

| | | | | |
|---|---|---|---|---|
| 693,693 | A * | 2/1902 | Edwards | 482/82 |
| 1,015,298 | A | 1/1912 | Cleland | |
| 1,184,056 | A | 5/1916 | Deventer | |
| 1,411,615 | A | 4/1922 | Evans | |
| 1,489,276 | A | 4/1924 | Railing et al. | |
| 1,608,995 | A | 11/1926 | Pletscher | |
| 1,769,784 | A * | 7/1930 | Hoppe | 446/217 |
| 1,775,166 | A | 9/1930 | Johnson | |
| 1,956,339 | A | 4/1934 | Bernasconi et al. | |
| 2,035,812 | A | 3/1936 | Janzen | |
| 2,117,976 | A | 5/1938 | Morris | |
| 2,390,877 | A | 12/1945 | Fisher | |
| 2,424,700 | A | 7/1947 | McMath | |
| 2,447,296 | A | 8/1948 | Wall | |

(Continued)

FOREIGN PATENT DOCUMENTS

| | | |
|---|---|---|
| DE | 4127254 | 2/1993 |

(Continued)

*Primary Examiner*—Eugene Kim
*Assistant Examiner*—Alyssa M Hylinski
(74) *Attorney, Agent, or Firm*—Rick Martin; Patent Law Offices of Rick Martin, P.C

(57) ABSTRACT

A non-battery operated rotating light and/or noise making toy apparatus is disclosed. The system includes a handle to which is connected an electro-mechanical LED power generation chamber. One or more LEDs are electronically connected to the power generation chamber. The power generation chamber contains a series of gears that drive a magnet through a rotational frequency dependent on the gear ratio. The magnet, in turn, induces a current into an induction coil with each rotation of the magnet as it rotates in a circular fashion via its positive and negative poles. The induced current consists of a positive and negative current. Current is fed into one or more LEDs or any type module such as a noisemaker, creating a standing pattern lighting effect and/or noisemaker. The frequency of the lighting of one LED is a function of the gear ratio with respect to the primary gear rotation to magnet rotation.

14 Claims, 11 Drawing Sheets

U.S. PATENT DOCUMENTS 2,535,041 A 12/1950 Clark
2,726,483 A * 12/1955 Hughes et al. ..... 446/242
2,739,419 A 3/1956 Cleveland
3,037,322 A * 6/1962 Baumgartner, Jr. ..... 446/242
3,142,052 A 7/1964 Tambert
3,325,940 A 6/1967 Davis
3,345,507 A 10/1967 Messinger
3,484,798 A * 12/1969 Disko et al. ..... 369/68
4,044,499 A 8/1977 Toler
4,080,754 A 3/1978 Nelson
4,114,305 A 9/1978 Wohlert et al.
4,315,301 A 2/1982 Jimena
4,360,860 A 11/1982 Johnson et al.
4,648,610 A 3/1987 Hegyi
4,701,835 A 10/1987 Campagnuolo et al.
4,709,176 A 11/1987 Ridley et al.
4,717,364 A * 1/1988 Furukawa ..... 446/175
4,775,919 A 10/1988 Pearsall et al.
4,890,528 A * 1/1990 Kamijima ..... 84/95.2
5,030,160 A * 7/1991 Klawitter ..... 446/242
5,057,827 A 10/1991 Nobile et al.
5,073,139 A 12/1991 Kassarich
5,190,491 A * 3/1993 Connelly ..... 446/242
5,275,417 A 1/1994 Seymour
5,406,300 A 4/1995 Tokimoto et al.
5,444,456 A 8/1995 Ohta et al.
5,580,093 A 12/1996 Conway
5,584,561 A 12/1996 Lahos
5,662,405 A 9/1997 Kuo
5,670,971 A 9/1997 Tokimoto et al.
5,718,499 A 2/1998 De Caro
5,791,966 A 8/1998 Capps et al.
5,844,377 A 12/1998 Anderson et al.
5,890,946 A 4/1999 Bloomfield
5,989,091 A * 11/1999 Rodgers ..... 446/153
6,037,876 A 3/2000 Crouch
6,077,194 A 6/2000 Chang
6,104,096 A 8/2000 Hicks
6,206,537 B1 3/2001 Hauck
D442,597 S 5/2001 Meyers et al.
6,239,774 B1 5/2001 Altman
6,249,998 B1 6/2001 NakaMats
6,270,391 B1 8/2001 Emilsson
6,291,900 B1 9/2001 Tiemann et al.
6,322,233 B1 * 11/2001 Brandt ..... 362/199
6,325,690 B1 12/2001 Nelson
6,382,820 B1 5/2002 Chung
6,404,409 B1 6/2002 Solomon
6,413,144 B1 7/2002 Williams
6,474,832 B2 11/2002 Murray
6,486,858 B1 11/2002 Altman
6,501,199 B2 12/2002 Hung
6,522,040 B2 2/2003 You
6,524,161 B1 2/2003 Asami
6,531,650 B1 * 3/2003 Chen ..... 84/94.1
6,550,945 B2 4/2003 Chiu
6,565,242 B2 5/2003 Dai
6,575,585 B2 6/2003 Nelson et al.
6,588,913 B1 7/2003 Huang
6,619,823 B2 9/2003 Dai
6,629,873 B2 10/2003 Shaw
6,695,671 B2 2/2004 Kessler
6,750,558 B1 6/2004 Bruhwiler
D493,491 S 7/2004 Smedley et al.
6,789,925 B1 9/2004 DeGregorio
6,802,758 B2 10/2004 Sommers
6,822,357 B2 11/2004 Hung
6,882,117 B1 4/2005 Hughes et al.
6,893,138 B1 5/2005 Jones
6,914,340 B2 7/2005 Becker et al.
6,930,403 B2 * 8/2005 Hartman et al. ..... 290/1 A
6,959,999 B2 11/2005 Lee
7,001,053 B1 2/2006 Chieh et al.
7,049,708 B2 5/2006 Hartman et al.
2002/0061705 A1 5/2002 Kirley
2003/0090892 A1 5/2003 Su
2004/0057463 A1 3/2004 Fu
2004/0090070 A1 5/2004 Eisenbraun
2004/0090210 A1 5/2004 Becker et al.
2004/0114385 A1 6/2004 Ho
2004/0141321 A1 7/2004 Dowling et al.
2004/0150230 A1 8/2004 Hartman et al.
2004/0156193 A1 8/2004 Chen
2004/0218383 A1 * 11/2004 Bailey, III ..... 362/169
2006/0050504 A1 3/2006 Mah
2006/0098426 A1 * 5/2006 Yen ..... 362/192

FOREIGN PATENT DOCUMENTS

GB 2088651 6/1982
WO WO9402776 2/1994
WO WO01/07131 2/2001

* cited by examiner

ROTATING LIGHT TOY

FIELD OF THE INVENTION

This invention relates to electronic novelty items and more particularly to hand held electronic devices that generate two-dimensional images via a spinning motion, not requiring a battery.

BACKGROUND OF THE INVENTION

Spinning novelty devices have been popular as children's toys for many years. They have been created in most all conceivable shapes and sizes. Most all these toys require a battery.

Electronic devices have added the ability to display images in two or three dimensions and often include electronics that encompass microprocessors. Electronic image and/or message displays often utilize light emitting diodes (LEDs) placed near the surface of the device. In order for the display to be readable, the lighting of the LEDs must be synchronized to a rate of movement of the surface containing the LEDs, otherwise the LEDs will appear as a blur and will not be readable or sharp in features. Synchronization is usually done via an internal sensor that senses the rate of speed of the LEDs or a technique whereby a preprogrammed speed must be reached prior to activating the LEDs. The power required by the electronic circuitry is typically supplied via batteries. U.S. Pat. No. 6,325,690 B1 to Nelson discloses a spinning top having a display and a current induced in an induction coil as the coil spins past a magnetic field.

The present invention is an improvement over the prior art electronic novelty toys having electronic displays. The present invention contains a unique internal power generator and method of LED synchronization based on each singular rotation. Thus, a child can pick up and spin a toy years after purchase, and the toy will light up and/or generate a sound.

SUMMARY OF THE INVENTION

An aspect of the present invention is to provide a self-generating and non-battery operated rotating lighted toy.

Another aspect of the present invention is to provide a self-powered (a non-battery dependent) energy source via its internal induction coil.

Yet another aspect of the present invention is to provide a repeatable LED on/off rotational frequency.

Another aspect of the present invention is to provide a repeatable produced sound during rotation of the rotating toy.

Another aspect of the present invention is to provide an emergency radio signal generator during rotation of the rotating toy.

Another aspect of the present invention is to provide an apparatus that is simple to manufacture and that is highly reliable.

Other features and advantages of the invention will become apparent from a consideration of the ensuing detailed description and drawings.

Other aspects of this invention will appear from the following description and appended claims, reference being made to the accompanying drawings forming a part of this specification wherein like reference characters designate corresponding parts in the several views.

The system includes a handle to which is connected an electro-mechanical LED activation chamber. One or more LEDs are electronically attached (tethered or otherwise connected) to the activation chamber. The activation chamber rotates about the handle and contains a series of gears that drive a magnet through a rotational frequency dependent on the gear ratio. The magnet, in turn, induces a current into an induction coil with each rotation of the magnet as it spins in a circular fashion via its positive and negative poles. The induced current consists of a positive and negative current. One or both currents are fed into one or more LEDs creating a standing pattern lighting effect. The current can also feed a sound or frequency generator module. The frequency of the lighting of one LED is a function of the gear ratio with respect to the primary gear rotation to magnet rotation.

The present invention comprises a handle, a housing chamber having a magnetic generator, and one or more LEDs. As the chamber spins around the handle, currents are generated to produce current pulses that are fed to one or more LEDs producing a standing pattern of light effect.

The present invention provides the following features:

a) A self powered generated rotating light apparatus. All energy is magnetically generated from the rotation of the body. The LED lighting follows a circular path as the housing spins.
b) One or more LED turns 'on' and 'off' at a relative same position (standing pattern) along the circular path relative to the handle and not any external parts.
c) The tangential speed (rpm) does not effect the position that the light turns 'on/off' but does affect the brightness of the light.
d) The rotational direction, clockwise (CW) or counter-clockwise (CCW) does not effect the position of lighting or the brightness.
e) A standing pattern effect is seen as each LED is 'on' and 'off' at the same relative position along the circular path.
f) If two LEDs (for example red, green) are placed on the same circular path and at two different polarities, they appear to alternate, thus producing an alternating two color standing pattern of lighting.
g) LEDs may be placed at varying angles and/or radial distances about the handle for effect.
h) Various LED configurations are easily adaptable.
i) Primary gear to magnet gear ratios may be changed to alter the number of on/off cycles per rotation.
j) There are a minimum number of parts for ease of manufacture and high reliability.

Although the present invention has been described with reference to the preferred embodiments, other product configurations could be designed having an internal generator with a connected LED. Examples could include, but are not limited to:

a) A baseball theme combining a handle in the shape of a bat with the generator hidden inside a baseball and one or more tethered LEDs.
b) A baseball theme combining a handle with the generator hidden inside and a tethered baseball containing one or more LEDs.
c) A golf theme combining a tee as a handle with the generator hidden inside a golf ball and one or more tethered LEDs.
d) A golf theme combining a tee as a handle with the generator hidden inside and a tethered golf ball containing one or more LEDs.
e) Many other sports or brand name type themes consisting of a handle, generator compartment and one or more tethered LEDs.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

The present invention is an apparatus consisting of a self-powered rotating power generator which is used to power a light and/or a sound module. The system includes a handle to about which rotates a connected electro-mechanical power generation chamber. One or more LEDs are electronically connected to the power generation chamber.

Figure 1:
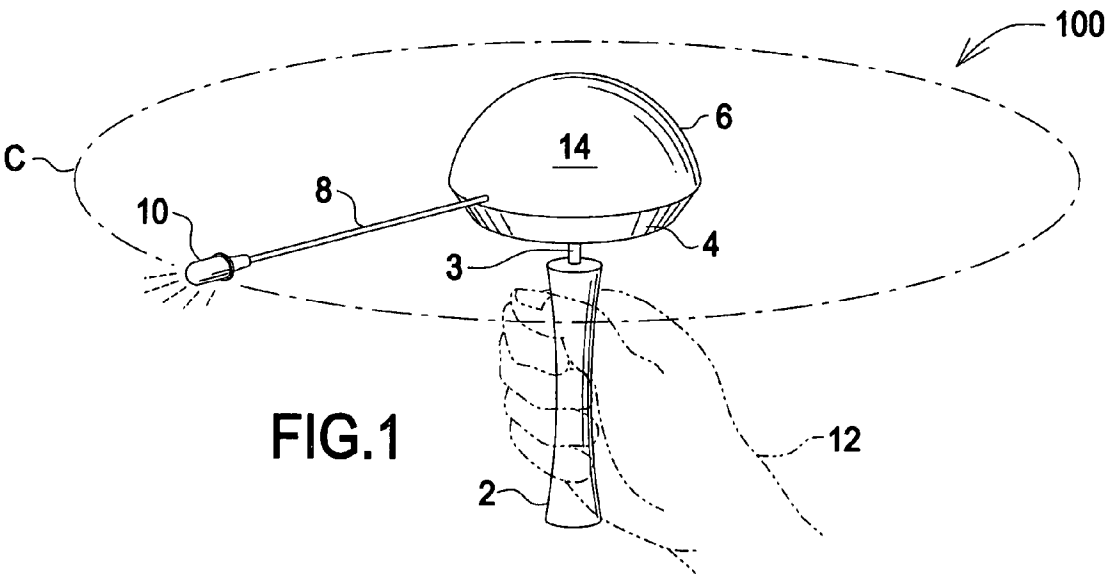
FIG. 1 is a side perspective view of the rotating light apparatus of the present invention.

FIG. 1 is a side perspective view of the rotating light apparatus 100 of the present invention. Handle 2 is constructed to be easily held by a user's hand 12, shaft 3 is affixed to handle 2 and is rotatably connected to a primary gear inside generation chamber 14, which serves as an electro-mechanical power generation chamber. Generation chamber 14 rotates about handle 2 and shaft 3. Generation chamber 14 consists of two halves; upper housing 6 and lower housing 4. Generation chamber 14 is constructed to spin about shaft 3. LED 10 is attached to upper housing 6 via connector 8. Connector 8 provides an electrical connection between LED 10 and upper housing 6. Connector 8 can be a tether or rigid connection or connected directly onto upper housing 6. Design choices for connector 8 include an insulated pair (or pairs) of wires or a rod with wires therein or a spring with wires or a rope having wires or any flexible or rigid structure capable of conducting current to LED 10. Handle 2 attaches to a gear within lower housing 4 such that a circular hand movement will cause a rotation of generation chamber 14 in a CW or CCW direction, which causes LED 10 to travel along arc C. LED 10 will turn 'on' and 'off' in a standing pattern type manner as it moves about arc C. Details of LED 10 activation will be discussed below. It should be noted that although FIG. 1 is shown with one LED, many other multiple LED configurations are possible.

Figure 2:
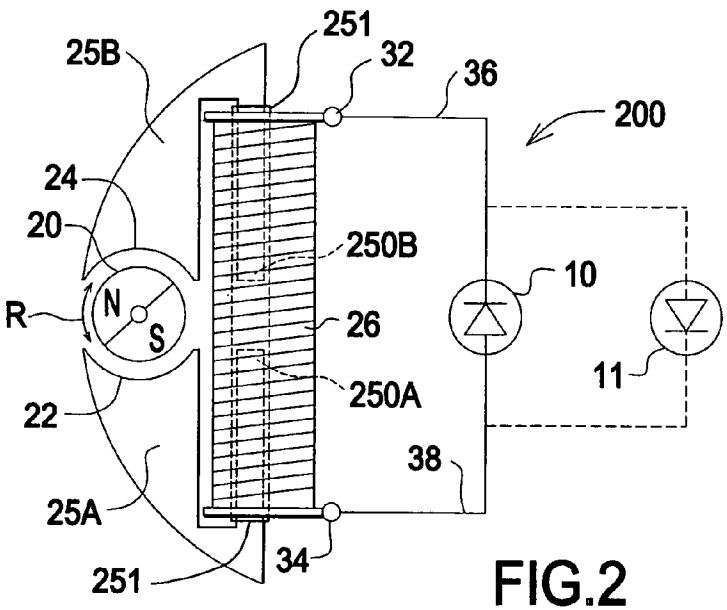
FIG. 2 is an electrical schematic of the rotating magnetic generator.

FIG. 2 is an electrical schematic of the rotating magnetic generator assembly 200. The rotating light apparatus includes a self-generating power generator having a rotating magnetic generator assembly 200 as will be described below. The actual process of how magnetic energy produces electricity is well known and will not be discussed in detail herein. The rotating magnetic generator assembly 200 consists of a spinnable magnet 20, spinning in either a CW or a CCW direction R, pick-up coil 26, and one or more LEDs 10, 11 connected to pick-up coil 26, which is wound around stator plates 25A, 25B. Stator plates 25A, 25B overlap and have corresponding ends 250A, 250B. Stator bar 251 resides atop both stator plates 25A, 25B within coil 26. Stator plates 25A, 25B have two faces 22, 24 that come in proximity to magnet 20 as it revolves. Magnet 20 is polarized into two half sections containing North 'N' and South 'S' poles. Magnet 20 is attached to and spins on a shaft (FIGS. 6, 7), said shaft is driven by gears to the desired rotational ratio. For example, one rotation of an input shaft could drive the magnet 30 turns. The magnetic energy is transferred via stator plates 25A, 25B, which passes through pick-up coil 26 and has two ends 250A, 250B that overlap each other under the coil winding. When magnet 20 is spun, an AC voltage is produced at the terminals 32, 34 of coil 26 and the voltage is subsequently transferred to LEDs 10, 11 via wires 36, 38. LED 10 is a diode and will light when the voltage polarity is correct. Because an AC voltage is generated, LED 10 will pass current only during a half-cycle, thus an LED 10 will light only once per one revolution of magnet 20. LED 10 will thus cycle 'on' and 'off' at about a 50% duty cycle. If a second LED 11 is connected in reverse polarity to the first LED 10, it will light alternately to the first LED 10 per revolution of the magnet.

Figure 3:
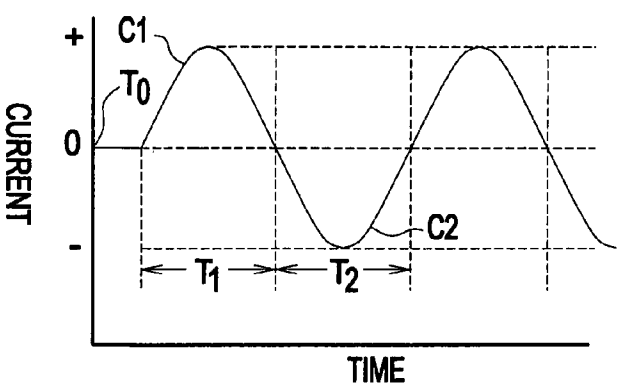
FIG. 3 is a current/time diagram of the magnetic generator assembly.

FIG. 3 is a current/time diagram of the magnetic generator assembly 200. Time $T_0$ represents the time when there is no movement of the magnet 20 and, thus, the current is 'zero'. As magnet 20 spins, current is generated by pick-up coil 26. The current increases as one pole of the magnet passes by one stator face. The polarity of the current pulse depends on the direction of spin of the magnet and the sense of winding of the pick-up coil about the stator. As an example, positive current C1, which has a duration time of $T_1$, will be generated as one pole passes a stator face. The current peaks as the pole is aligned with the stator face, and as the pole passes by the stator face, the current drops to zero. As the opposite pole starts to pass the same stator face 22 the current is again produced but in the opposite direction (negative current) as shown by C2, which has a duration time of $T_2$. Current passing through the pick-up coil produces a voltage pulse across coil points 32, 34. LED 10 (which acts as a diode) will pass positive current C1 during time $T_1$ and pass zero current during time $T_2$. Thus LED 10 is 'on' during time $T_1$ and is 'off' during time $T_2$. Likewise, if a second LED 11 is connected (opposite polarity to LED 10), it will not pass current during time $T_1$ but will pass current C2 during time $T_2$. Each LED, as shown, operates at a 50% duty cycle. The amount of 'on/off' cycles per revolution can be controlled by the gear ratio of the magnet, which is attached to a driven gear, versus the primary gear. One complete spin of magnet 20 results in two current pulses, one positive and one negative, represented by the total time of $T_1$ plus $T_2$.

Voltage increases with RPM (angular velocity) and, therefore, it is desirable for the voltage to peak between three and four volts at high to maximum RPM, which is sufficient to power most LEDs without damage and still be able to produce a very bright light. Ultra-bright and Super-bright LEDs work best with this configuration, as their voltage requirements are lower than others. In the two LED configuration, the diodes (LEDs) actually help protect each other from reverse voltage damage.

Figure 4:
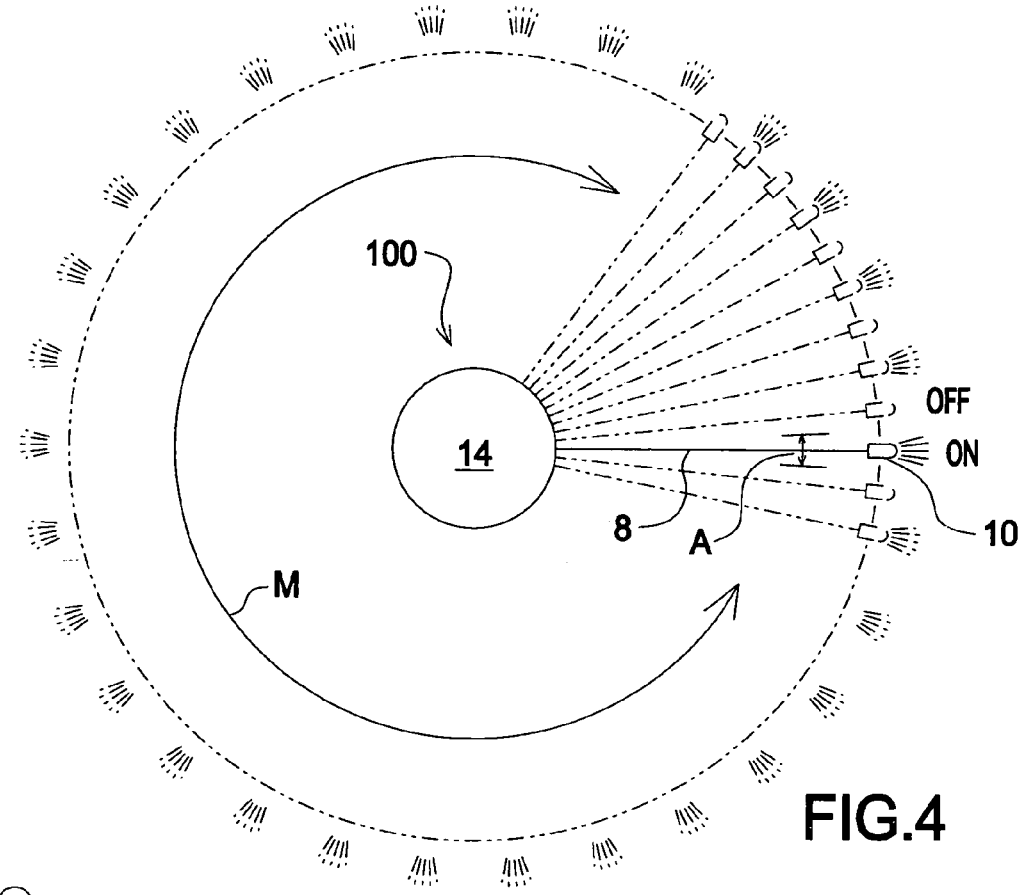
FIG. 4 is a top view of the rotating light apparatus of the present invention in motion.

For example movement of the handle results in rotations of the activation chamber and primary gear. Movement will be in a CW or CCW direction depending on the initial user movement of the handle. The ratio of gears in the activation chamber then affects the number of magnet spins per rotation of the activation chamber. For example, if the magnet were to spin 30 times per one rotation of the primary gear, the LED would illuminate 30 times per rotation on the connector 8 (ref. FIG. 4 below). The present invention is not limited by gear ratios. A gear ratio of 30:1 is used herein as an exemplary description as other gear ratios are possible.

FIG. 4 is a top view of the rotating light apparatus 100 of the present invention in motion. Rotating light apparatus 100 is shown having one LED 10 attached to generation chamber 14 via connector 8. Motion direction M of LED 10 can be either CW or CCW depending on the initial motion generated by the user. If the primary gear to magnet gear ratio were 1:30, then the rotating magnet would rotate 30 times for every rotation of LED 10, and LED 10 would thus be 'on' 30 times per revolution as shown. LED 10 would also be 'off' thirty times per revolution. Thus the angular 'on' time A would be about 6 degrees and the angular 'off' time would be about 6 degrees per on/off cycle providing a standing pattern image of 30 lights per 360° circular arc. The LED lighting thus follows a circular path as the housing rotates and turns 'on' and 'off' at the relative same position along the circular path relative to the handle. The tangential speed (rpm) does not effect the position that the light turns 'on/off' but does affect the brightness of the light. The faster the user spins the toy, the brighter the light.

Figure 5A:
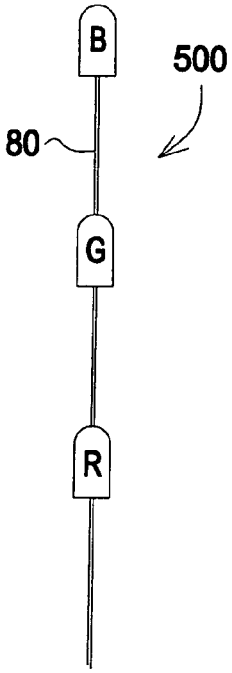
FIGS. 5A, 5B are top views of a three-LED configuration to attach to the generation chamber, an alternate configuration of the present invention.
Figure 5B:
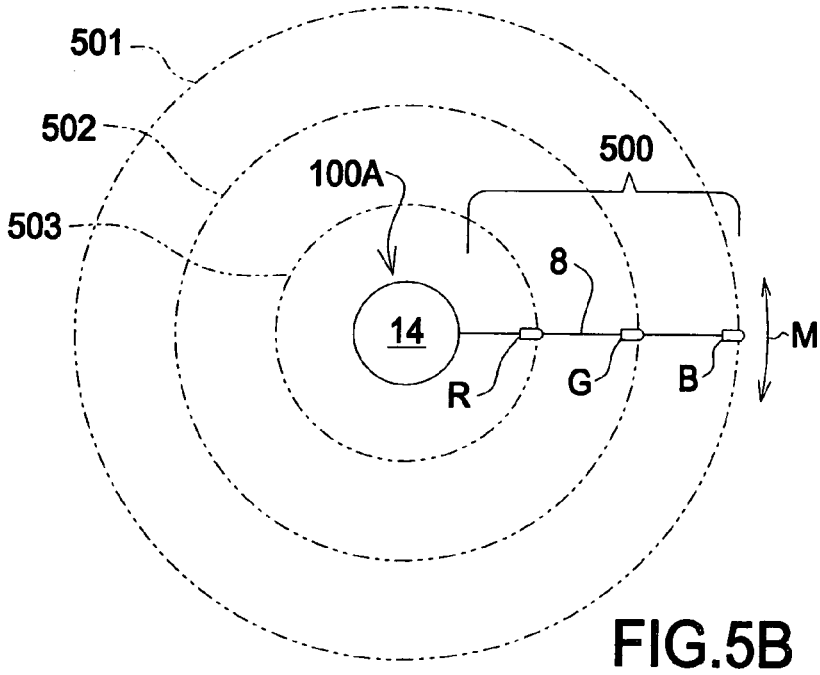

FIGS. 5A, 5B are top views of a three-LED configuration 500 to attach to generation chamber 14, an alternate configuration of the present invention numbered 100A. FIG. 5A depicts three LED's R,G,B affixed at various radial lengths along main connector 80. Each LED can be connected to the same or mixed polarizations of the pick-up coil (26, FIG. 2). The resulting image will be three circular standing patterns 501, 502, 503 as shown in FIG. 5B. In the configuration shown, the outer circle 501 will be a 'blue' standing pattern effect, the mid circle 502 a 'green' standing pattern effect and the inner circle 503 a 'red' standing pattern effect. On/off timing will be a function of how each LED is connected to the positive or negative current pulse. As previous mentioned, initial motion can be in either CW or CCW in direction M.

Figure 5C:
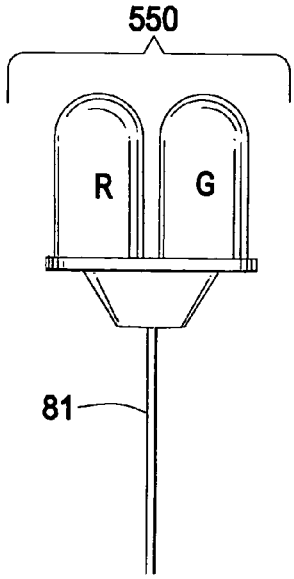
FIGS. 5C, 5D are top views of a two-LED configuration, an alternate configuration of the present invention.
Figure 5D:
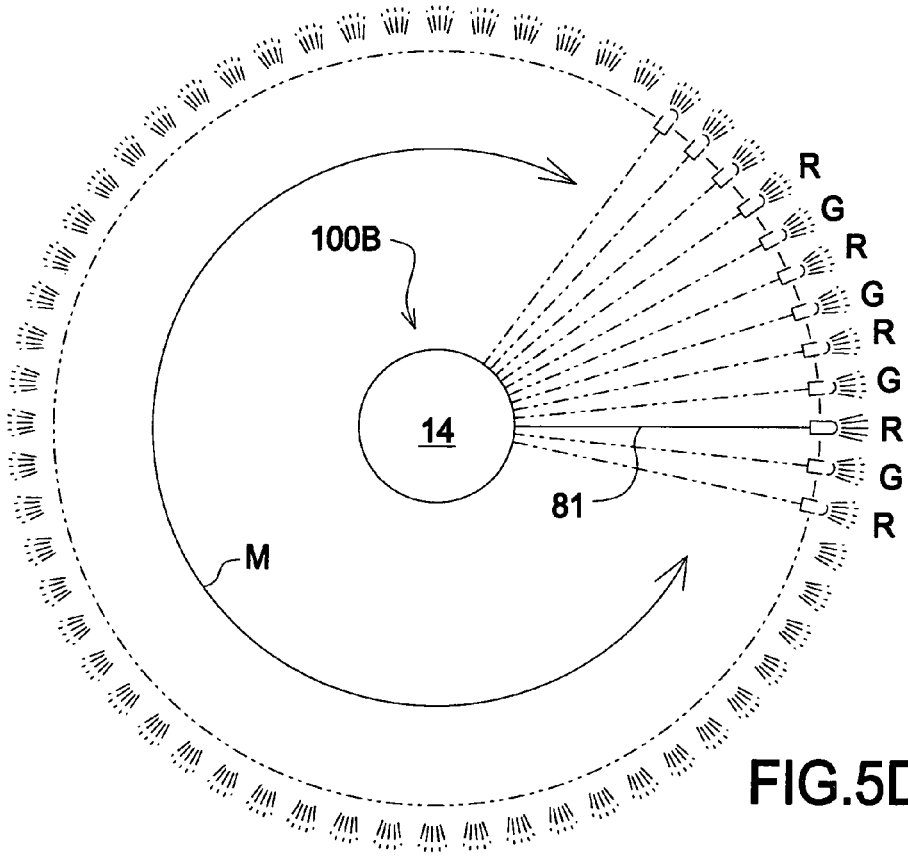

FIGS. 5C, 5D are top views of a two-LED configuration 100B an alternate configuration of the present invention. Connector 81 would have four wires and is fitted with dual LED 550. Each of the LEDs R, G are attached via electrical connector 81 to generator chamber 14 at the same radial distance and attached at an opposite polarity. One LED will be 'off' when the other LED is 'on'. Thus, the effect, as depicted in FIG. 5D, is alternating colors of 'red' and 'green' about the outer circle created by motion in either a CW or a CCW direction 'M' of connector 81 as generator chamber 14 rotates about the handle.

Figure 6B:
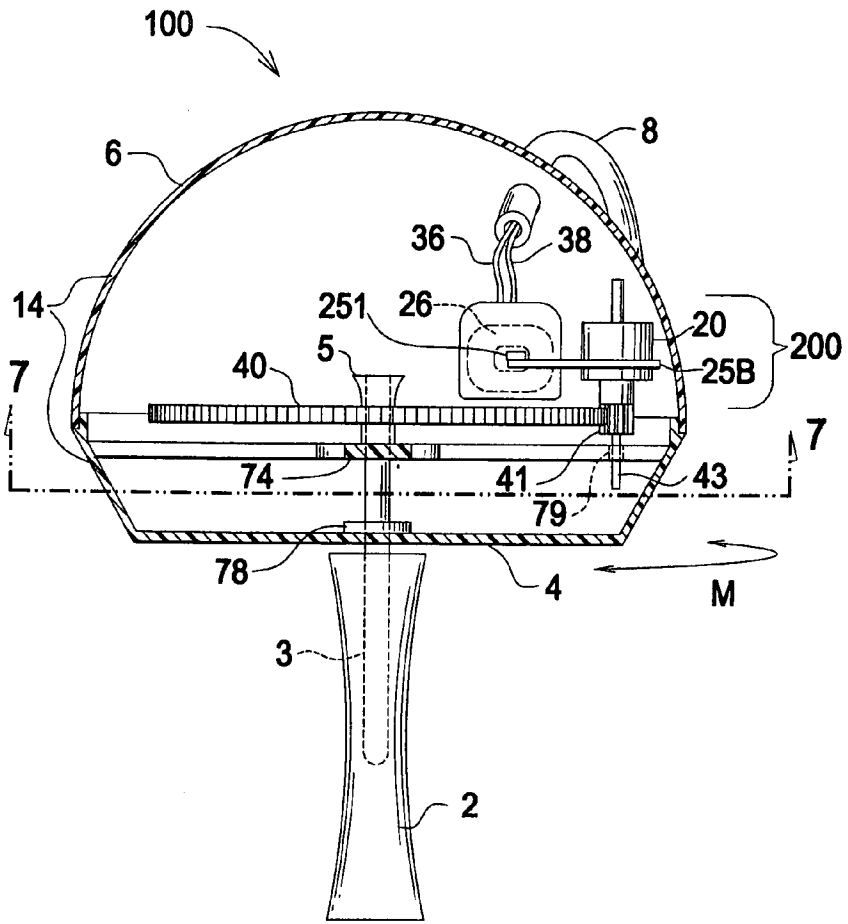
FIG. 6B is a side internal view of the rotating light apparatus with the pinion gear at a side position of the primary gear.
Figure 6A:
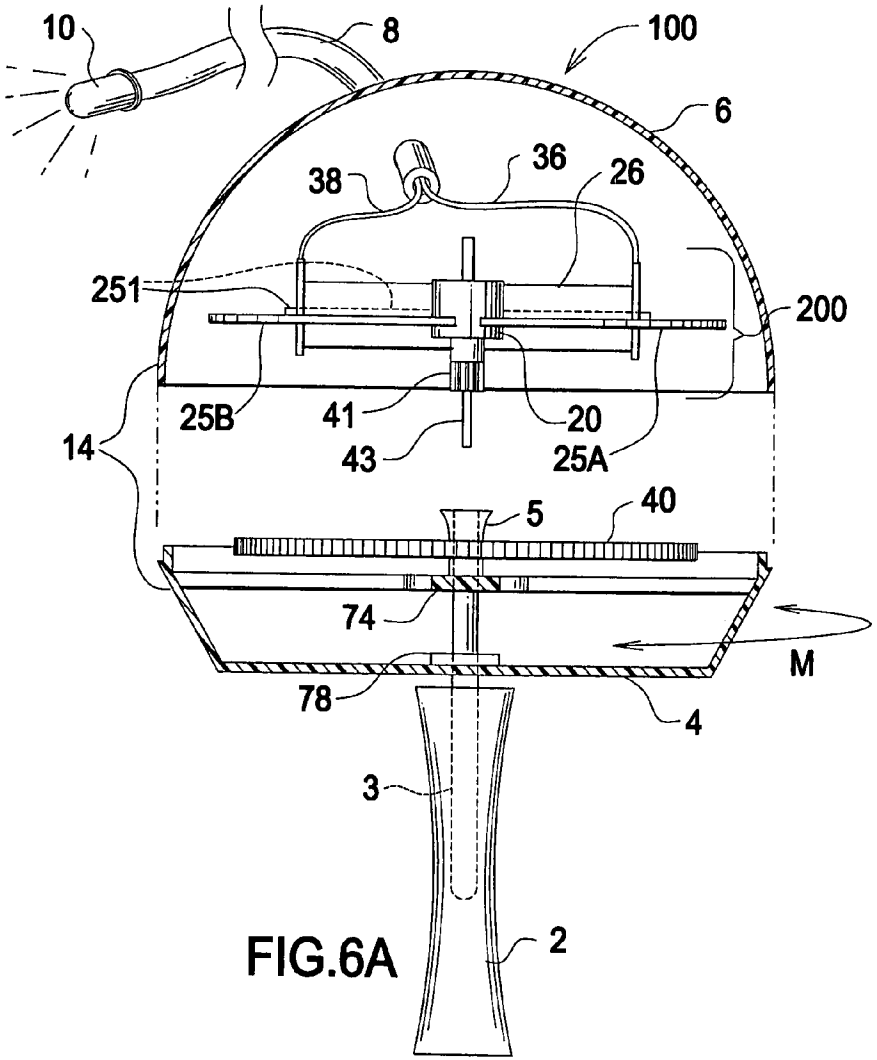
FIG. 6A is a side internal view of the rotating light apparatus with the pinion gear in a frontal position of the primary gear.

FIG. 6A is a side internal view of the rotating light strobe apparatus 100 with the pinion gear 41 in a frontal position of the primary gear 40. Generation chamber 14 is shown split into its two halves; upper housing 6 and lower housing 4. Handle 2 is rigidly connected to shaft 3, which is directly affixed to primary gear 40 with upper pivot support 5. Generation chamber 14 is rotatably connected to shaft 3 via bushings 74, 78 that are a part of lower housing 4 structure. Thus generation chamber 14 can readily rotate around handle 2, shaft 3 and primary gear 40 in direction M, either CW or CCW. LED 10 is attached to upper housing 6 via electronic connector 8. Connector 8 provides an electrical connection between LED 10 and upper housing 6. Pinion gear 41 is directly attached to magnet 20 via shaft pin 43, thus one rotation of pinion gear 41 results in one corresponding spin of magnet 20. Shaft pin extends to a support structure bushing within lower housing 4. As generation chamber 14, and thus magnetic generator assembly 200 rotates, pinion gear 41 rotates about primary gear 40, which is directly attached to handle 2 via shaft 3. To generate 30 'on/off' cycles per housing rotation, primary gear would have 240 gear teeth as compared to 8 gear teeth for pinion gear 41. Thus, a ratio of 240:8, or 30:1 is formed. It should be noted that although FIG. 6 is shown with one LED, many other multiple LED configurations are possible.

FIG. 6B is a side internal view of the rotating light apparatus 100 with the pinion gear 41 at a side position of the primary gear 40. Thus pinion gear 41 is 90° from its position shown in FIG. 6A. Generation chamber 14 is rotatably connected to shaft 3. Thus generation chamber 14 can readily spin CW or CCW in direction M around handle 2, shaft 3 and primary gear 40, which are all affixed to one another. LED 10 is attached to generation chamber 14 via electronic connector 8. Connector 8 provides an electrical connection to LED 10. Pinion gear 41 is directly attached to magnet 20 via shaft pin 43, thus one rotation of pinion gear 41 results in one corresponding spin of magnet 20. Shaft pin 43 is supported by bushing 79 on lower housing 4. As generation chamber 14, and thus magnetic generator assembly 200 rotates, pinion gear 41 rotates about primary gear 40.

Figure 7:
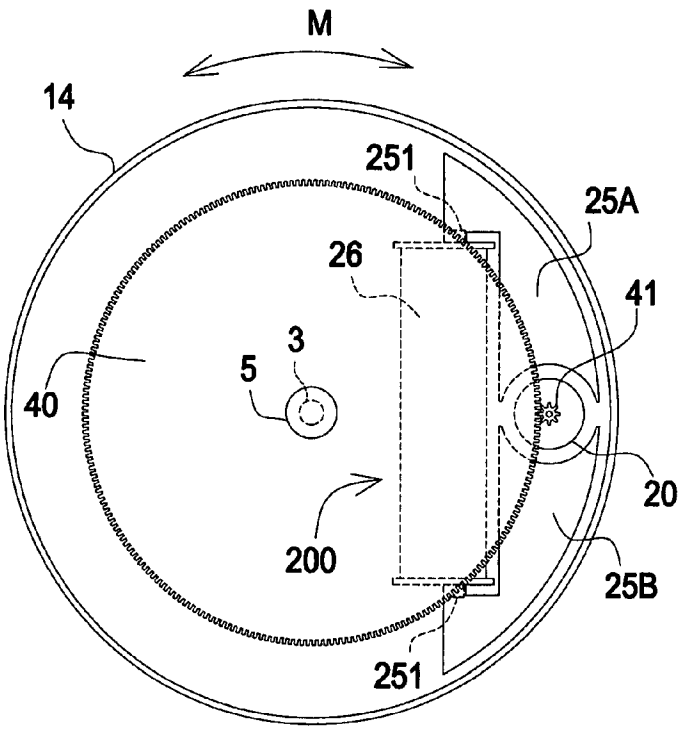
FIG. 7 is a bottom internal view of the housing chamber of the present invention along plane 7-7 of FIG. 6B.

FIG. 7 is a bottom internal view of the generation chamber 14 along plane 7-7 of FIG. 6B. Pivot support 5 and shaft 3 are directly attached to primary gear 40. Pinion gear 41 rotates in direction M (CW or CCW) about primary gear 40 in the aforementioned ratio of 30:1. It should be noted that other gear ratios could easily be changed to adjust the angular frequency of the 'on/off' cycles.

Figure 8:
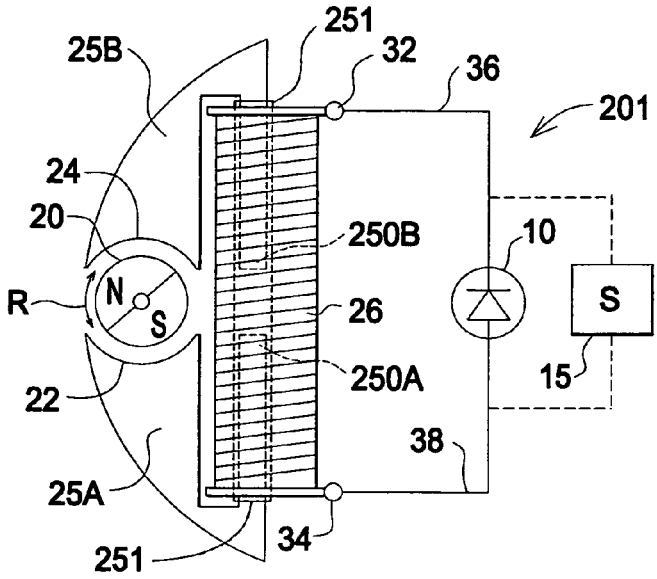
FIG. 8 is an electrical schematic of the rotating magnetic generator driving both an LED and a sound module.

FIG. 8 is an electrical schematic of the rotating magnetic generator driving both an LED 10 and a sound module 15 as represented by system 201. FIG. 8 is the same as FIG. 2 except the second LED 11 has been replaced with sound module 15. As such, the rotating light apparatus of the present invention can produce an electronically generated sound. For example, a chirping sound or a whistle type sound could be produced from sound module 15 along with a standing light pattern from LED 10.

FIGS. 9 thru 13 represent several examples of possible designs of the present invention. It should be noted that the present invention is not limited by the examples presented. All examples function in a manner previously described in FIGS. 1 thru 4.

Figure 9:
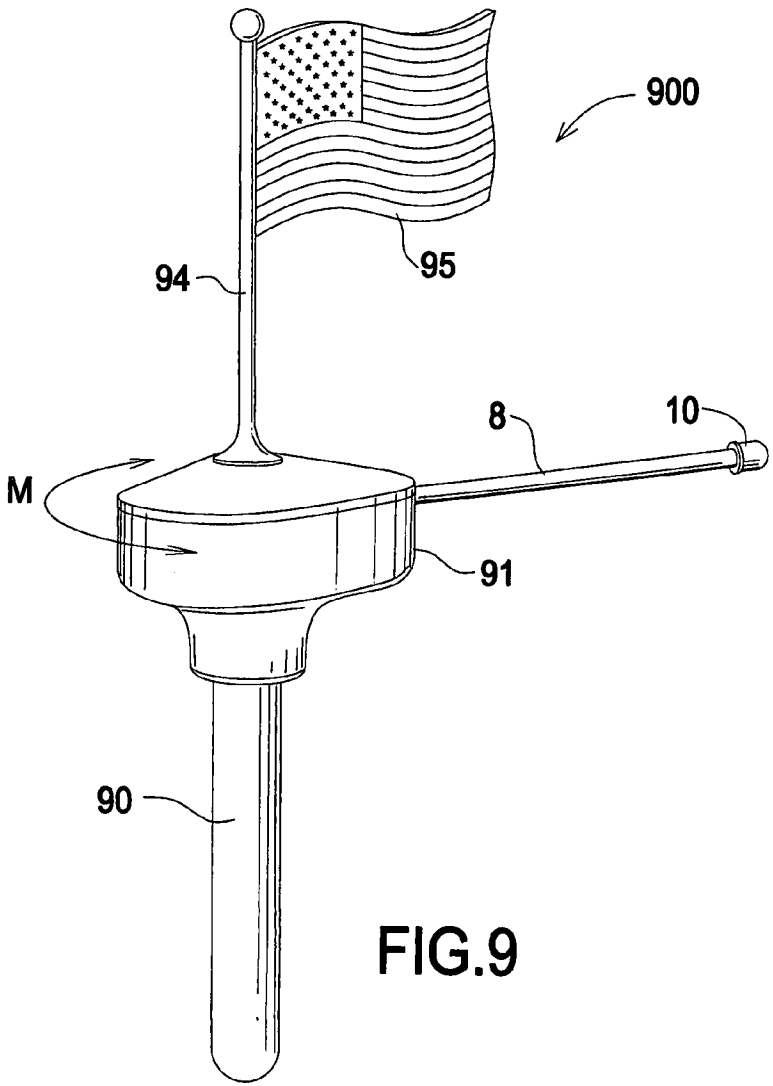
FIG. 9 is a side perspective view of an American flag mount design.

FIG. 9 is a side perspective view of an American Flag mount design 900. Flag base housing 91 spins about flag handle 90, either CW or CCW in direction M. Flag 95 is attached to flag pole 94 that is mounted to flag base housing 91. LED 10 and connector 8 attach to flag base housing 91 and thus spin with flag base housing 91.

Figure 10:
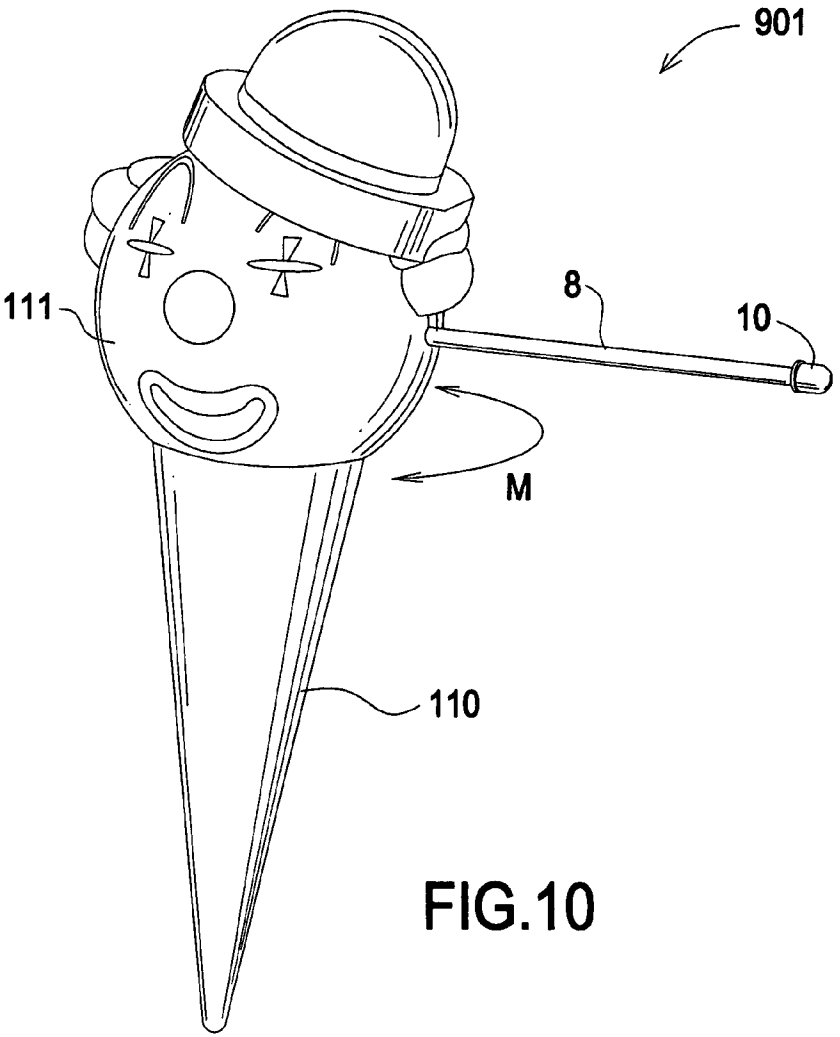
FIG. 10 is a side perspective view of assembly having an Ice Cream Cone base with a Clown Head top.

FIG. 10 is a side perspective view cone assembly 901 having an Ice Cream Cone base 110 with a Clown Head top 111. Clown Head top 111 spins about Ice Cream Base 110, either CW or CCW in direction M. LED 10 and connector 8 attach to Clown Head top 111 and thus spin with Clown Head top 111.

Figure 11:
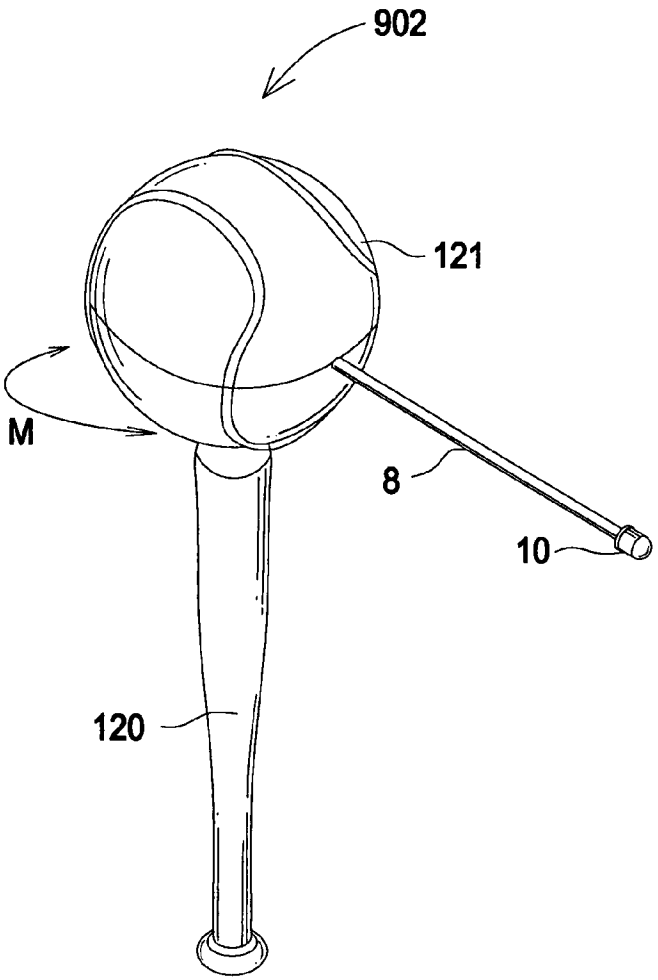
FIG. 11 is a side perspective view of a Bat and Ball assembly having a Bat base with a Baseball top.

FIG. 11 is a side perspective view of Bat and Ball assembly 902 having a Bat base 120 with a Baseball top 121. Baseball top 121 spins about Bat 120, either CW or CCW in direction M. LED 10 and connector 8 attach to Baseball top 121 and thus spin with Baseball top 121.

Figure 12:
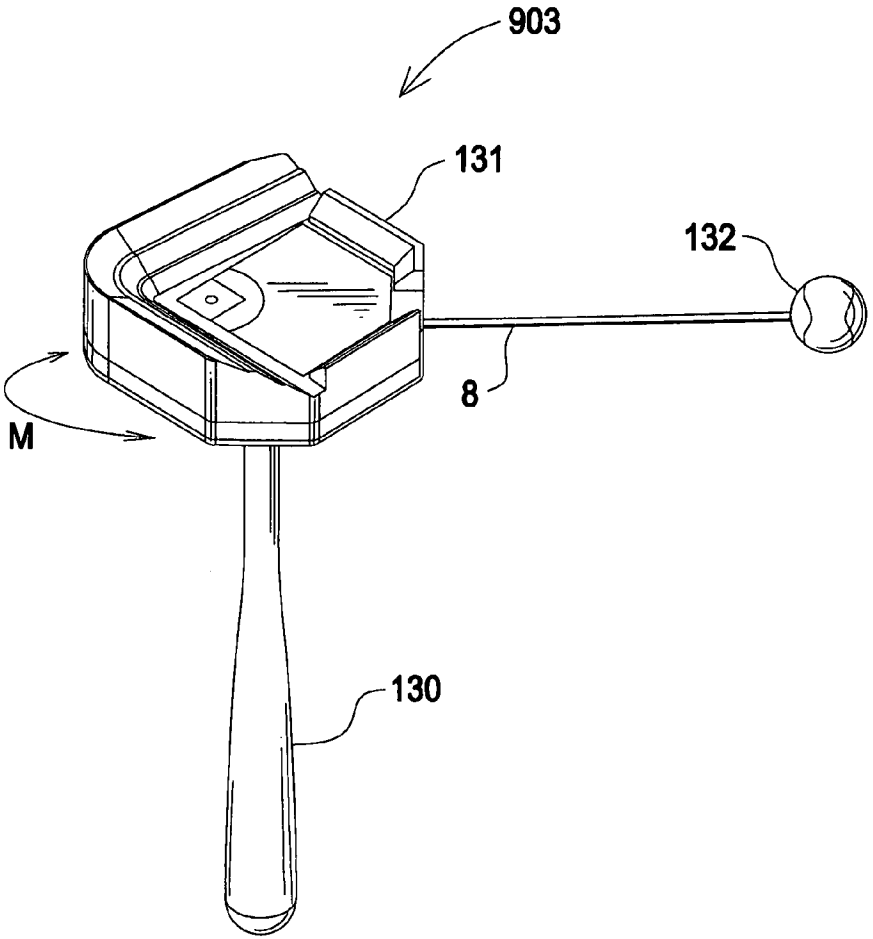
FIG. 12 is a side perspective view of Bat and Baseball Stadium assembly having a Bat base with a Baseball Stadium top.

FIG. 12 is a side perspective view of Bat and Baseball Stadium assembly 903 having a Bat base 130 with a Baseball Stadium top 131. Baseball Stadium top 131 spins about Bat 130, either CW or CCW in direction M. An LED, enclosed within baseball 132, and connector 8 attach to Baseball Stadium top 131 and thus spin with Baseball Stadium top 131 and baseball 132 provides a standing light pattern as it spins.

Figure 13:
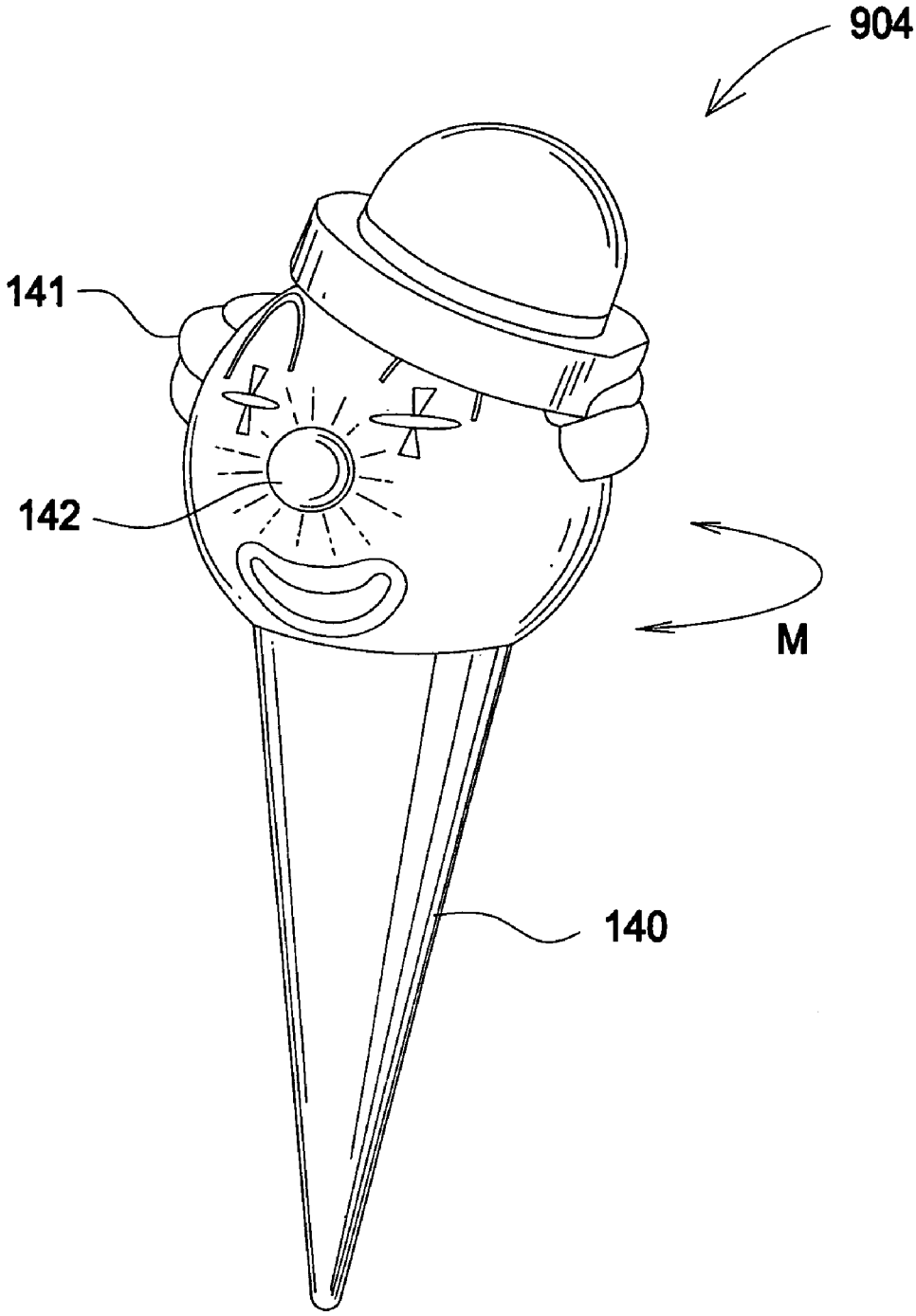
FIG. 13 is a side perspective view of a cone assembly having an Ice Cream Cone base with a Clown Head top and having an LED directly attached to a Clown Head top.

FIG. 13 is a side perspective view of a cone assembly 904 having an Ice Cream Cone base 140 with a Clown Head top 141 and having an LED enclosed within Clown Head nose 142. Clown Head top 111 spins about Ice Cream Base 110, either CW or CCW in direction M. Clown Head nose 142 thus lights in a standing light pattern as Clown Head top 141 spins.

Figure 14:
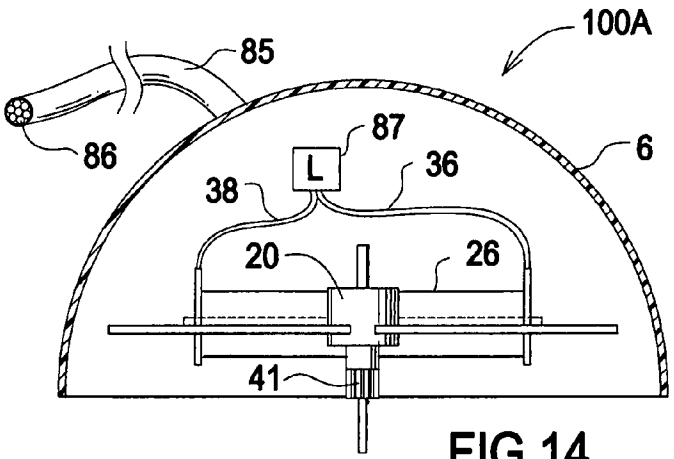
FIG. 14 is a side internal view of the rotating light apparatus having a fiber optic display.

FIG. 14 is a side internal view of the rotating light apparatus 100A having a fiber optic display 86. FIG. 14 is similar to FIG. 6A except fiber optic module 87 has been added to drive fiber optic bundle 86.

Figure 15:
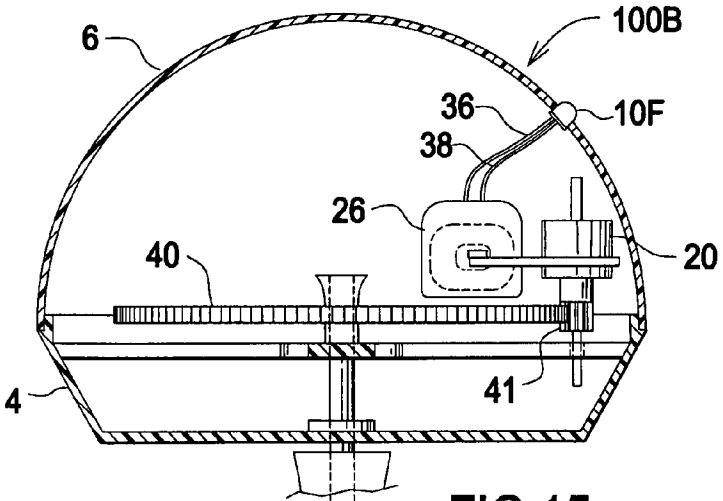
FIG. 15 is a side internal view of the rotating light apparatus with the pinion gear at a side position of the primary gear and the LED directly attached to the upper housing of the generation chamber.

FIG. 15 is a side internal view of the rotating light apparatus 100B with the pinion gear 41 at a side position of the primary gear 40 and LED 10F directly attached to upper housing 6 of generation chamber 14, otherwise FIG. 15 is the same as FIG. 6B. This configuration would produce a standing light pattern directly on upper housing 6. Although only one LED has been shown, one or more LED, fiber optic and/or sound devices could be employed.

Figure 16:
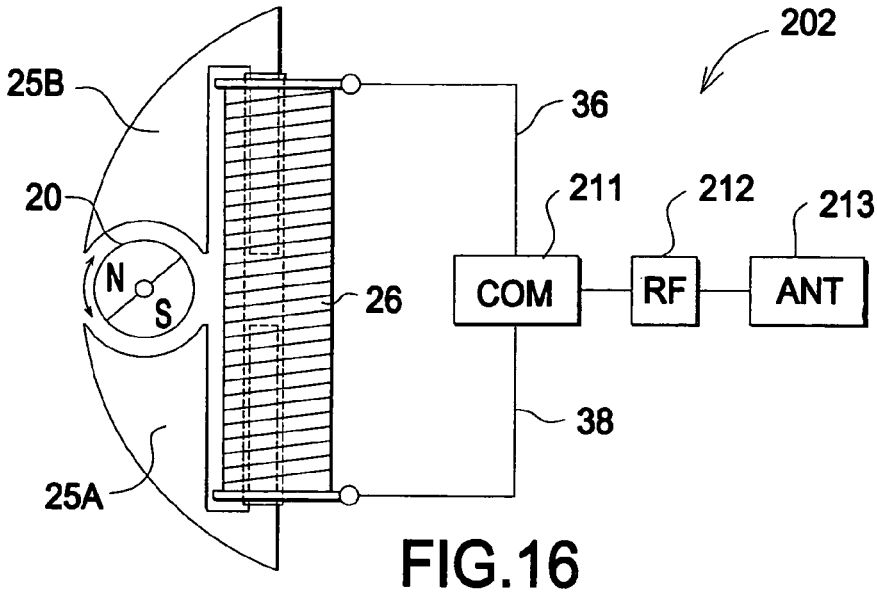
FIG. 16 is an alternate circuit schematic embodiment of the present invention providing an emergency signal.

FIG. 16 is an alternate circuit schematic embodiment 202 of the present invention providing an emergency signal. Electrical commutator 211 provides a commutated DC voltage to RF generator 212 that puts out a chosen frequency signal and/or an "SOS" type of chosen signal to antenna 213. This alternate embodiment can provide an emergency signal to a monitoring station.

Figure 17A:
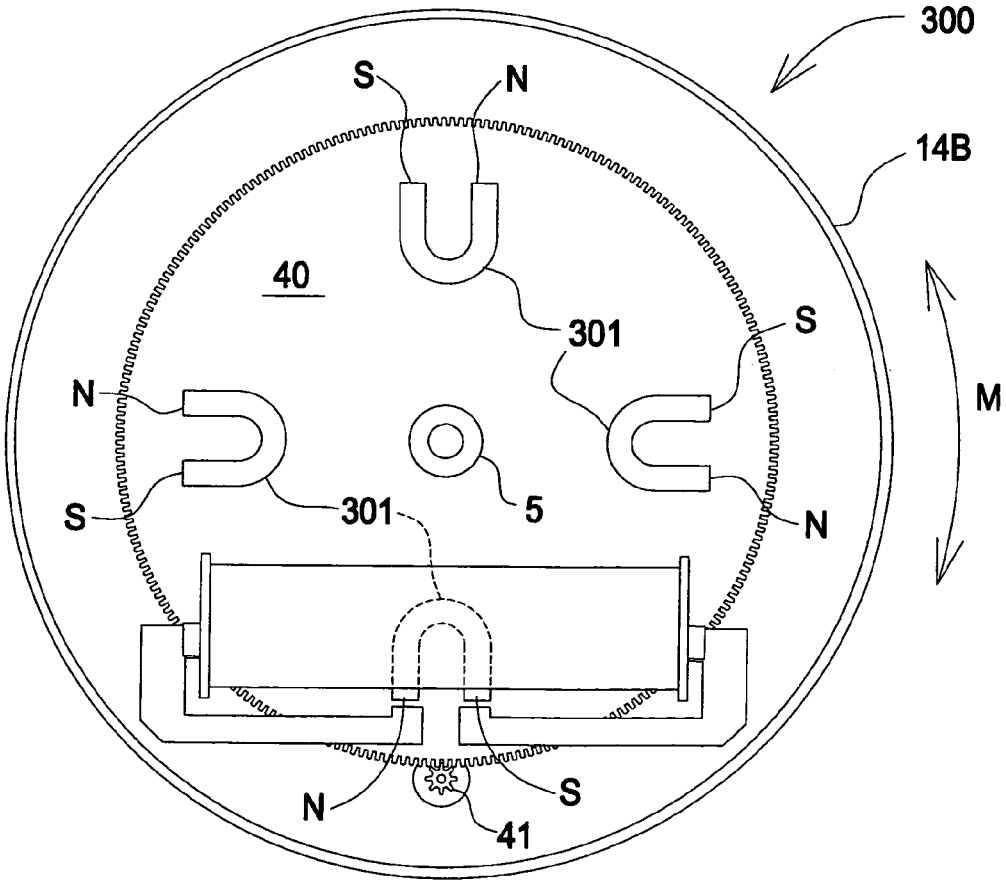
FIG. 17A is a top view of a fixed magnet rotating light apparatus, an alternate embodiment of the present invention.

FIG. 17A is a top view of a fixed magnet rotating light apparatus 300, an alternate embodiment of the present invention. All components are the same as shown in FIG. 7 with the exception that spinning magnet 20 (FIG. 7) has been replaced with four fixed magnets 301 that are affixed to primary gear 40. It should be noted that any amount of fixed magnets may be used and that four magnets are shown as an exemplary embodiment. All components are housed in generation chamber 14B. As magnetic generator assembly 200B rotates on pinion gear 41 about primary gear 40, stator faces 25C, 25D will pass by north N and south S poles and thus the magnetic fields created by fixed magnets 301. As stator faces 25C, 25D pass by the magnetic fields, a positive and negative current will be induced into coil 26 at the four locations of fixed magnets 301. Thus, with four fixed magnets, there will be only four positive and four negative current pulses generated as magnetic generator assembly 200B passes each of the four magnetic fields.

Figure 17B:
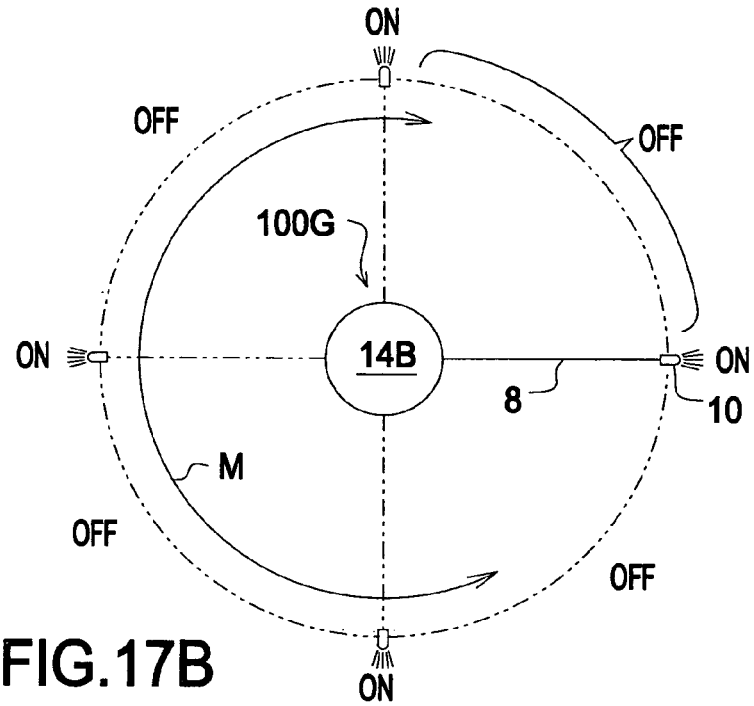
FIG. 17B is a top view of the fixed magnet rotating light apparatus of the present invention in motion.

FIG. 17B is a top view of the fixed magnet rotating light apparatus 100G in motion. With four fixed magnets 301 in the positions shown in FIG. 17A, LED 10 momentarily will turn with generation housing 14B and light 'on' at 90° increments about its moving arc. This will create a standing light pattern of four points about its arc of rotation as shown. It should be noted that the number and the location of lit points about the circle of rotation is a direct function of the amount of fixed magnets 301 present and their respective location.

Figure 18:
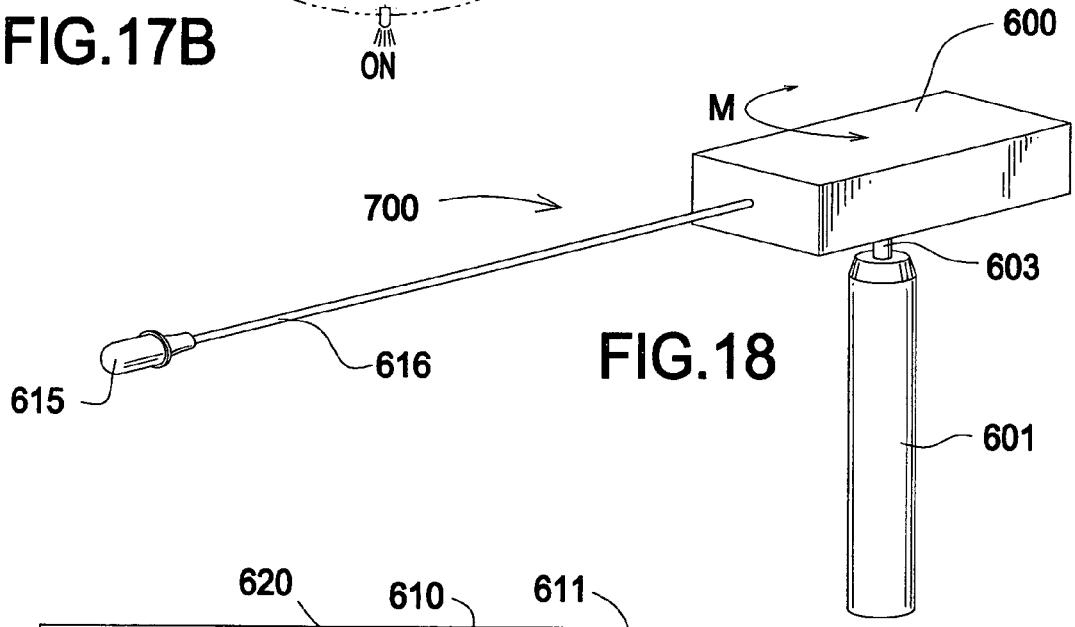
FIG. 18 is a front perspective view of a three gear rotating light toy, an alternate embodiment of the present invention.

FIG. 18 is a front perspective view of a three-gear rotating light toy 700, an alternate embodiment of the present invention. The rotating toy works in the same manner as the aforementioned rotating light toy 100 described above in FIGS. 1, 2, 3, 4, 6A, 6B, 6C, 7 but has a different gear makeup. Handle 601 attached to a primary gear (604, FIG. 19) via primary shaft pin 602 (FIG. 19, 20), which has protecting cover 603. Three-gear generator chamber 600 rotates in a CW or CCW direction M via hand movement of handle 601. LED 615 is electronically attached to three-gear generator chamber 600 by connector 616. It should be noted that three-gear rotating light toy 700 is shown by way of example and that the present invention is not limited to the number of gears within nor to gear ratios.

Figure 19:
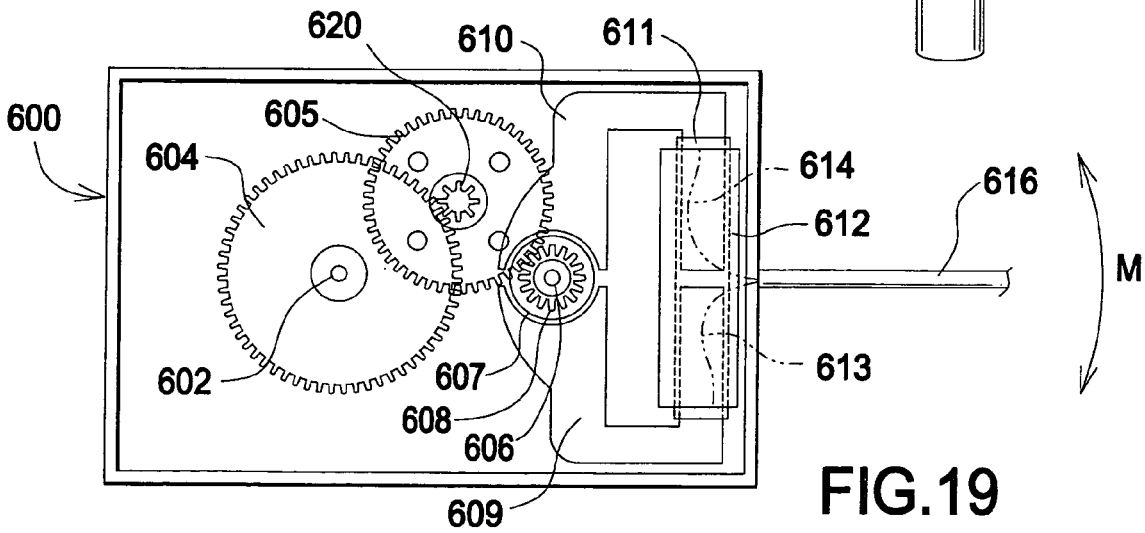
FIG. 19 is a top internal view of the three-gear generation chamber.

FIG. 19 is a top internal view of the three-gear generator chamber housing 600. Connector 616 is connected to coil 612 by wires 613, 614. Stators 609, 610 and stator bar 611 can be easily seen. Magnet 607 is directly attached to gear 608 via shaft pinion shaft pin 606. Primary shaft pin 602 is affixed to primary gear 604. Movement of the handle causes three-gear generator chamber housing 600 to move CW or CCW in direction M. Primary gear 604 has 60 teeth that directly drive the 8 lower teeth 620 of the intermediate gear, thus a ratio of 60:8 or 7.5:1 is formed. Intermediate gear has 48 outer teeth 605 that directly drive pinion gear 608 at its 16 outer teeth, thus a secondary ratio of 48:16 or 4:1 is formed. Thus both ratios form an overall drive ratio of 7.5 times 4 or 30:1. Magnet 607 is directly attached to pinion gear 608 and thus turns 30 times per revolution primary gear 604 and thus per revolution of three-gear generator chamber housing 600. As this ratio is the same as the ratio of aforementioned rotating light toy 100, the three-gear rotating light toy 700 will produce 30 on/off cycles per rotation. Previously described electronic FIGS. 2, 3 thus apply, as well as the on/off timing depiction shown in FIG. 4 when the three-gear rotating toy is in motion.

Figure 20:
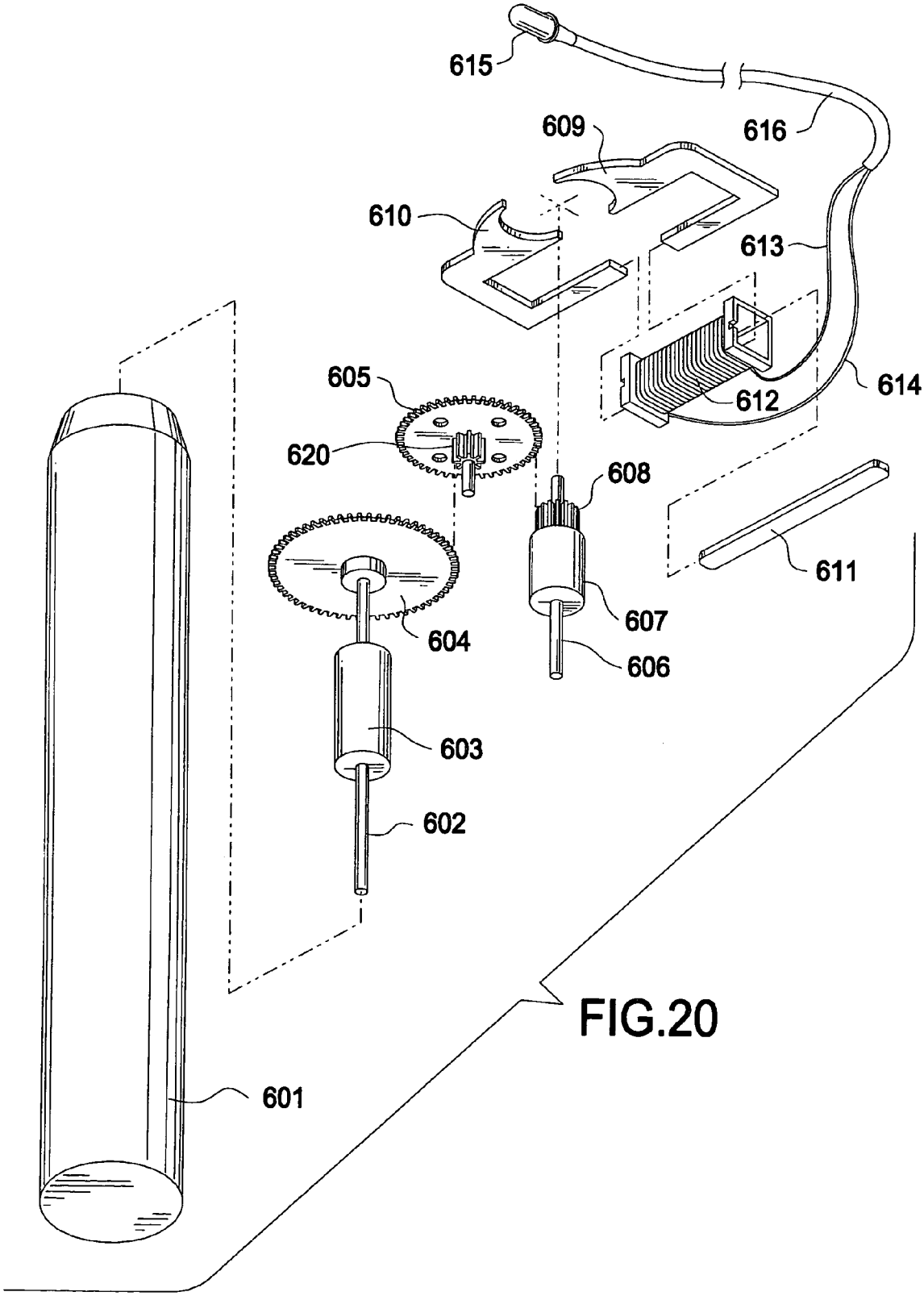
FIG. 20 is a bottom perspective blow up view of the components of the three-gear rotating light toy.

FIG. 20 is a bottom perspective blow up view of the components of three-gear rotating light toy 700 without generator chamber housing 600 shown. Handle 601 attaches to primary gear 604 via primary shaft pin 602, which has protective casing 603 for support. Primary shaft pin 602 is directly affixed to primary gear 604. Primary gear 604 has 60 teeth that directly drive the 8 lower teeth 620 of the intermediate gear, thus a ratio of 60:8 or 7.5:1 is formed. Intermediate gear has 48 outer teeth 605 that directly drive pinion gear 608 at its 16 outer teeth, thus a secondary ratio of 48:16 or 4:1 is formed. Thus both ratios form an overall drive ratio of 7.5 times 4 or 30:1. Magnet 607 is directly attached to pinion gear 608 and thus spins 30 times per revolution of primary gear 604 and thus of three-gear generator chamber housing 600. Magnet 607 is directly attached to pinion gear 608 via shaft pinion shaft pin 606 and thus also spins 30 times per revolution of primary gear 604. As the overall ratio (30:1) is the same as the ratio of aforementioned rotating light toy 100, the three-gear rotating light toy 700 will produce 30 on/off cycles per rotation primary gear 604, and thus generator housing 600. Coil 612 will thus produce 30 positive and 30 negative current pulses as shown previously in FIG. 3. Connector 616 is connected to coil 612 by wires 613, 614. Stator bars 609, 610 and internal stator bar 611 can be easily seen. Previously described electronic shown FIGS. 2, 3 thus apply, as well as the on/off timing depiction shown in FIG. 4 when the three-gear rotating toy is in motion.

It should be noted that although the above invention has been described with LEDs, other technologies could be readily adapted to this invention. It should also be noted that other gear ratios and/or quantity of gears could be utilized to define the angular frequency of 'on/off' cycles per rotation.

Although the present invention has been described with reference to preferred embodiments, numerous modifications and variations can be made and still the result will come within the scope of the invention. No limitation with respect to the specific embodiments disclosed herein is intended or should be inferred.

We claim:

1. An electric power generator comprising:

a fixed primary gear having a handle sized to fit in a user's hand;

a secondary gear assembly having a secondary gear engaged with the primary gear;

said secondary gear assembly mounted to a housing which rotates about the handle;

wherein said secondary gear assembly rotates around the primary gear during a user's motion imparted to the handle;

a magnet affixed to the secondary gear;

a stator/coil assembly mounted in proximity to the magnet on the secondary gear assembly;

said stator/coil assembly comprising a coil wound about a stator segment on the secondary gear assembly;

wherein the motion imparted to the handle causes the secondary gear assembly with its stator/coil assembly to rotate about the periphery of the primary gear via the engagement with said secondary gear;

said motion further causes said magnet to spin on said secondary gear within said secondary gear assembly in relation to said stator/coil assembly, thereby generating an electrical current in said stator/coil assembly;

an electronic device electrically connected to the stator/coil assembly;

wherein the electronic device is an LED;

wherein the LED is connected to the secondary gear assembly; and wherein the LED rotates around the handle with the housing and the secondary gear assembly.

2. The generator of claim 1, wherein a primary gear to secondary gear ratio is greater than one.

3. The generator of claim 1, wherein the LED cycles on and off to form a standing pattern of light.

4. The generator of claim 1, wherein the electronic device further comprises a sound module.

5. The generator of claim 1, wherein the electronic device further comprises a radio transmitter.

6. A spinning toy comprising:

a handle sized to fit in a user's hand;

a primary gear fixedly attached to the handle;

a secondary gear assembly rotatably mounted to the handle;

said secondary gear assembly having a magnet affixed to a secondary gear which is engaged with the primary gear;

said secondary gear is spun by the primary gear when the secondary gear assembly is rotated around the handle by a user's motion;

said secondary gear assembly further comprising a stator mounted in proximity to the magnet and a coil wound around the stator;

wherein the user's imparting the movement to the handle causes the secondary gear and magnet to spin in relation to the stator which generates a current in the coil;

an electronic module driven by the current; and wherein the secondary gear assembly, stator, electronic module, and the spinning magnet rotate about the handle during the movement of the handle.

7. The toy of claim 6, wherein the electronic module is an LED mounted to the secondary gear assembly via a tether; and wherein the LED spins around the primary gear with the secondary gear assembly.

8. The toy of claim 6, wherein the electronic module is a sound module.

9. The toy of claim 6, wherein the electronic module is a radio transmitter.

10. A light display toy comprising:

a handle sized to be grasped by a user's hand;

a fixed primary gear fixedly connected to a top of the handle;

a power generation chamber rotatably connected to the top of the handle;

said power generation chamber having a pinion gear engaged with the primary gear;

wherein a circular hand movement by the user causes the power generation chamber to rotate around the handle, thereby causing the pinion gear to spin around the primary gear;

a magnet having a north and south pole fixedly attached to the pinion gear;

said power generation chamber further comprising a coil wound around a stator;

wherein the spinning of the magnet via the pinion gear generates a voltage in the stator;

an LED attached to the power generation chamber; and wherein the voltage powers the LED during the circular hand movement, thus rotating the LED with the power generation chamber, the coil, the stator, and the spinning magnet.

11. An electric power generator comprising:

a rotatable housing mounted to a user handle via a primary shaft;

said rotatable housing having a lower segment;

a fixed primary gear connected to said handle and mounted within said rotatable housing, so as to allow said rotatable housing to rotate around said fixed primary gear;

a secondary gear assembly connected to said lower segment by an axle for a secondary gear;

said secondary gear assembly comprising:

a secondary gear;

a spinnable magnet mounted to the secondary gear, spinnable in relation to a stator/coil assembly;

wherein said stator/coil assembly is fixedly mounted in proximity to said magnet on said secondary gear assembly;

wherein said secondary gear meshes with said primary gear, and said secondary gear rotates around the periphery of said primary gear during a user initiated circular motion of the handle;

wherein said motion causes said rotatable housing including the secondary gear assembly to rotate about the handle;

wherein said rotation causes said rotatable magnet to spin in relation to said stator/coil assembly;

thereby generating an electric current in said stator/coil assembly; and an electronic device electrically connected to said stator/coil assembly and connected to said rotatable housing.

12. The electric power generator of claim 11, wherein said electronic device is a light.

13. The electric power generator of claim 12, wherein said light is a fiber optic light.

14. The electric power generator of claim 12, wherein the light flashes on/off in a standing pattern due to an output signal from the stator/coil assembly.

* * * * *